US005363969A

United States Patent [19]

Shen

[11] Patent Number: 5,363,969

[45] Date of Patent: Nov. 15, 1994

[54] COMBINED COSMETIC CASE AND PICTURE STAND

[75] Inventor: Wen-Chang Shen, Tainan City, Taiwan, Prov. of China

[73] Assignee: Mei Shual Cosmetics Co., Ltd., Tainan City, Taiwan, Prov. of China

[21] Appl. No.: 100,973

[22] Filed: Aug. 3, 1993

[51] Int. Cl.[5] ..... A45D 42/02; B65D 69/00

[52] U.S. Cl. ..... 206/581; 132/305; 206/45.24

[58] Field of Search ..... 206/581, 235, 45.24; 132/294, 296, 301, 302, 305

[56] References Cited

U.S. PATENT DOCUMENTS

| | | | |
|---|---|---|---|
| 1,538,786 | 5/1925 | Feldman | 132/301 |
| 1,993,938 | 3/1935 | McDonald | 132/301 X |
| 2,190,273 | 2/1940 | Shapiro | 132/296 X |
| 2,224,995 | 12/1940 | Vogel | 132/304 |
| 2,421,646 | 6/1947 | Pepin | 132/305 |
| 2,485,814 | 10/1949 | Cohan | 132/301 |
| 3,557,804 | 1/1971 | Lerner | 132/305 |
| 3,949,767 | 4/1976 | Rose | 132/301 |
| 5,218,978 | 6/1993 | Yang et al. | 132/304 |

*Primary Examiner*—Paul T. Sewell
*Assistant Examiner*—BethAnne C. Cicconi
*Attorney, Agent, or Firm*—Ladas & Parry

[57] ABSTRACT

A combined cosmetic case and picture stand includes first and second cosmetic casing halves, a transparent pane member and a stand member. The first and second cosmetic casing halves are hinged to one another and are retained releasably in a closed position. The first cosmetic casing half has an outer side which is formed with a central recess for receiving a picture therein. The second cosmetic casing half has an inner side which confines a space for receiving cosmetic therein and an outer side which is formed with a groove unit. The pane member has a shape which corresponds to that of the central recess. The pane member is received in the central recess and is formed with a peripheral frame unit that is mounted detachably to the outer side of the first cosmetic casing half. The stand member is received in the groove unit and is mounted pivotally to the outer side of the second cosmetic casing half.

4 Claims, 3 Drawing Sheets

COMBINED COSMETIC CASE AND PICTURE STAND

BACKGROUND OF THE INVENTION

1. Field of the Invention

The invention relates to a cosmetic case, more particularly to a combined cosmetic case and picture stand.

2. Description of the Related Art

Conventional cosmetic cases are adapted to receive cosmetic therein and are incapable of accomplishing other functions.

The objective of the present invention is to provide a dual-purpose cosmetic case.

More specifically, the objective of the present invention is to provide a combined cosmetic case and picture stand.

SUMMARY OF THE INVENTION

Accordingly, the combined cosmetic case and picture stand of the present invention comprises:

first and second cosmetic casing halves which are hinged to one another and which are provided with a catch means for retaining releasably the first and second cosmetic casing halves in a closed position, the first cosmetic casing half having an outer side which is formed with a central recess for receiving a picture therein, the second cosmetic casing half having an inner side which confines a space for receiving cosmetic therein and an outer side which is formed with a groove unit;

a transparent pane member having a shape which corresponds to that of the central recess, the pane member being received in the central recess and being formed with a peripheral frame unit that is mounted detachably to the outer side of the first cosmetic casing half; and a stand member mounted pivotally to the outer side of the second cosmetic casing half, the stand member being movable between a first position, wherein the stand member is received in the groove unit, and a second position, wherein the stand member forms an angle with the outer side of the second cosmetic casing half.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
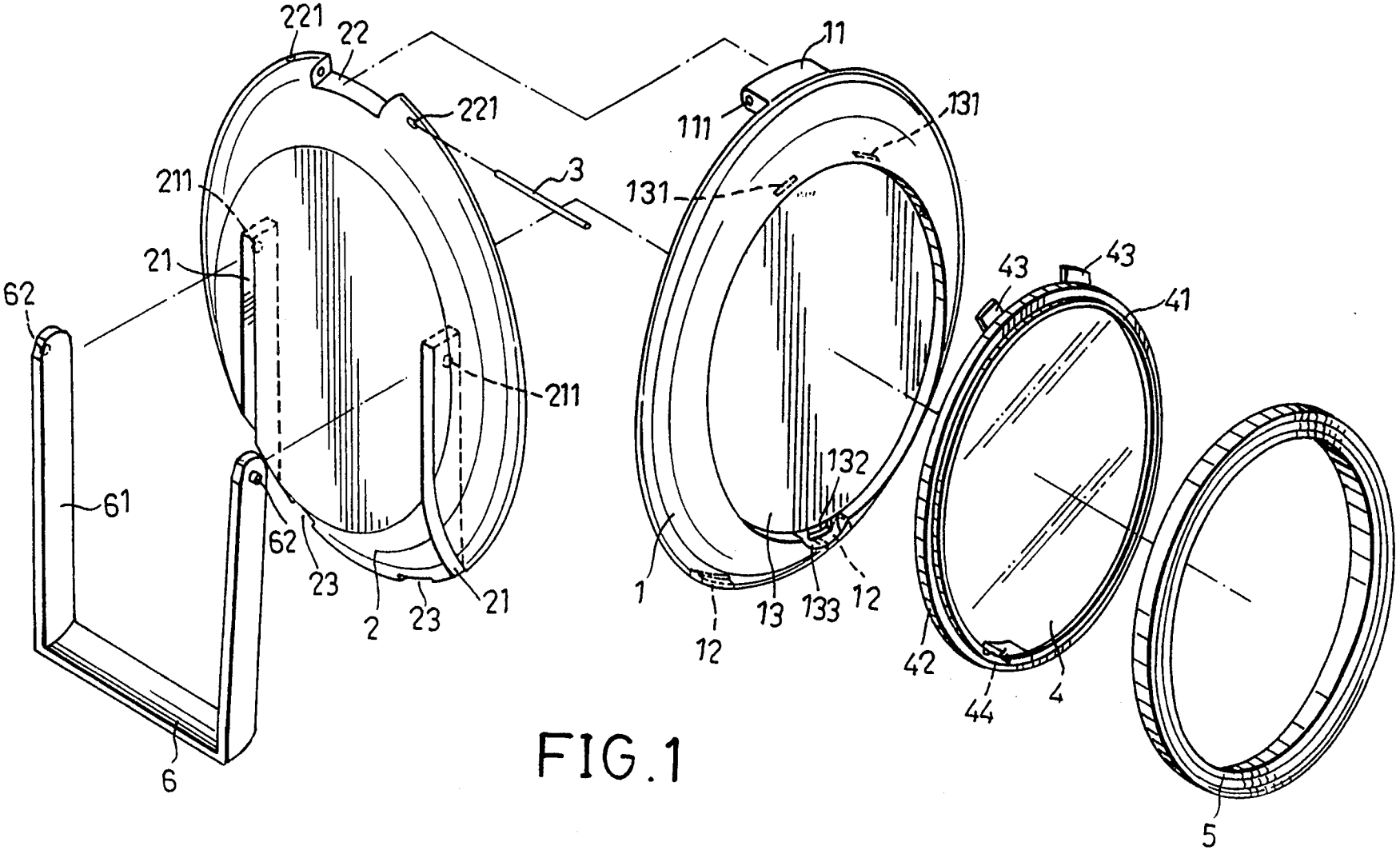
FIG. 1 is an exploded view of the preferred embodiment of a combined cosmetic case and picture stand of the present invention.
Figure 2:
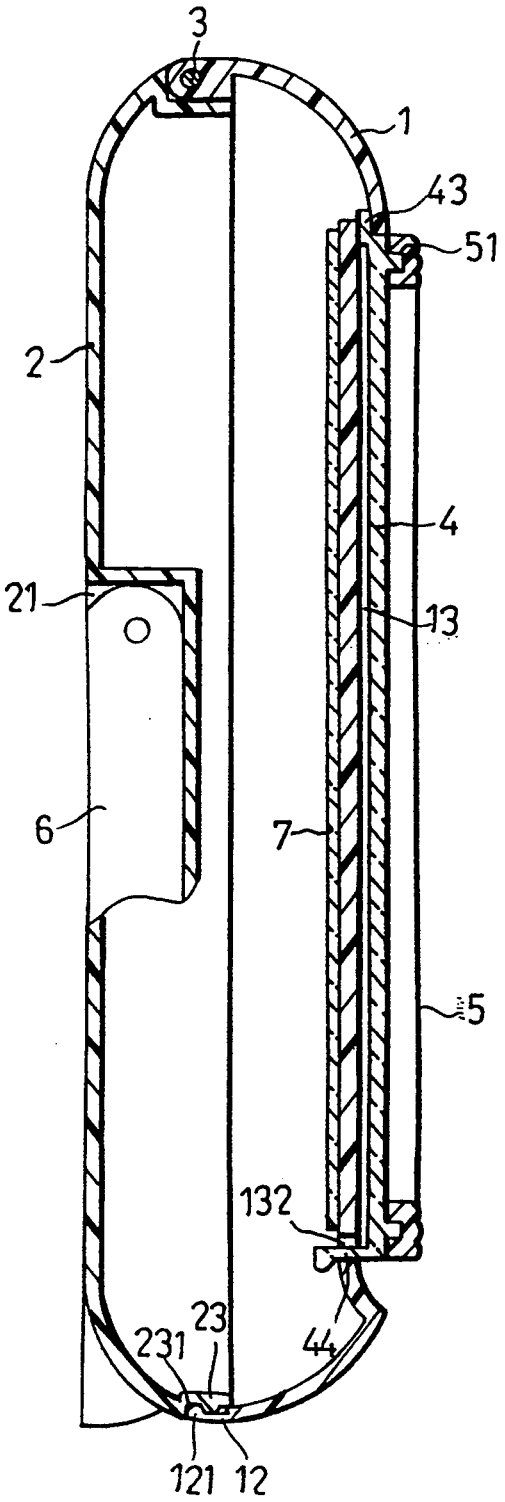
FIG. 2 is a sectional view of the preferred embodiment.

Referring to FIGS. 1 and 2, the preferred embodiment of a combined cosmetic case and picture stand according to the present invention is shown to comprise first and second cosmetic casing halves 1, 2, a pane member 4, a looped decorative frame 5, and a stand member 6.

The first and second cosmetic casing halves 1, 2 are fastened to one another in a conventional manner and are shaped so as to complement with one another. In this embodiment, the periphery of the first cosmetic casing half 1 is formed with a rearwardly projecting pivot lug 11. The pivot lug 11 has a through hole 111 formed therethrough. The periphery of the first cosmetic casing half 1 is further formed with a spaced pair of first catch projections 12. The first cosmetic casing half 1 further has an inner side with a mirror 7 attached thereon. The periphery of the second cosmetic casing half 2 is formed with a notch 22 that corresponds with the pivot lug 11 and a spaced pair of second catch projections 23 that correspond respectively with the first catch projections 12. The second cosmetic casing half 2 has an inner side which confines a space for receiving cosmetic therein and an outer side which is formed with a groove unit that includes a pair of parallel elongated grooves 21. The second cosmetic casing half 2 is further formed with a pair of oppositely oriented pivot holes 211 respectively disposed in the elongated grooves 21, and a pair of aligned pin holes 221 on two sides of the notch 22. During assembly, the pivot lug 11 extends into the notch 22, and a pivot pin 3 extends through the pin holes 221 and the through hole 111 of the pivot lug 11 to hinge together the first and second cosmetic casing halves 1, 2. Each of the second catch projections 23 is formed with a groove 231 that receives releasably a projection 121 of the corresponding first catch projection 12, thereby retaining releasably the first and second cosmetic casing halves 1, 2 in a closed position. The first cosmetic casing half 1 further has an outer side which is formed with a central recess 13 for receiving a picture (not shown) therein. The outer side of the first cosmetic casing half 1 has an inner periphery which confines the central recess 13 and which is formed with a spaced pair of radial insert holes 131, a notch 133 opposite to the insert holes 131, and a fastening groove 132 formed in the notch 133.

The pane member 4 is made of a transparent material and has a shape which corresponds to that of the central recess 13. The pane member 4 is received in the central recess 13 and is formed with a peripheral frame unit which includes a frontwardly extending portion 41 and a radially extending portion 42. The radially extending portion 42 is provided with a spaced pair of radial insert projections 43 that correspond respectively with the insert holes 131 and a fastening unit 44. When the pane member 4 is mounted on the first cosmetic casing half 1, the insert projections 43 are inserted into the respective insert holes 131 while the fastening unit 44 is pressed so as to engage releasably the fastening groove 132.

The looped decorative frame 5 has a wavy decorative front surface and a rear surface which is formed with a peripheral groove 51. The peripheral groove 51 is adapted to receive the frontwardly extending portion 41 of the frame unit of the pane member 4 therein, thereby mounting detachably the decorative frame 5 on the pane member 4.

The stand member 6 is a generally U-shaped member with two upright arms 61. The upright arms 61 extend into the elongated grooves 21 of the second cosmetic casing half 2 and are each formed with a pivot projection 62 that extends into a respective one of the pivot holes 211, thereby mounting the stand member 6 pivotally onto the second cosmetic casing half 2. Note that the combined thickness of the upright arm 61 and the pivot projection 62 should be slightly smaller than that of the elongated groove 21, while the distance between the upright arms 61 should be slightly wider than that between the elongated grooves 21. When mounting the stand member 6 on the second cosmetic casing half 2, the upright arms 61 are pressed together so as to extend into the elongated grooves 21. The upright arms 61 are then released in order to enable the pivot projections 62 to extend into the pivot holes 211.

Figure 3:
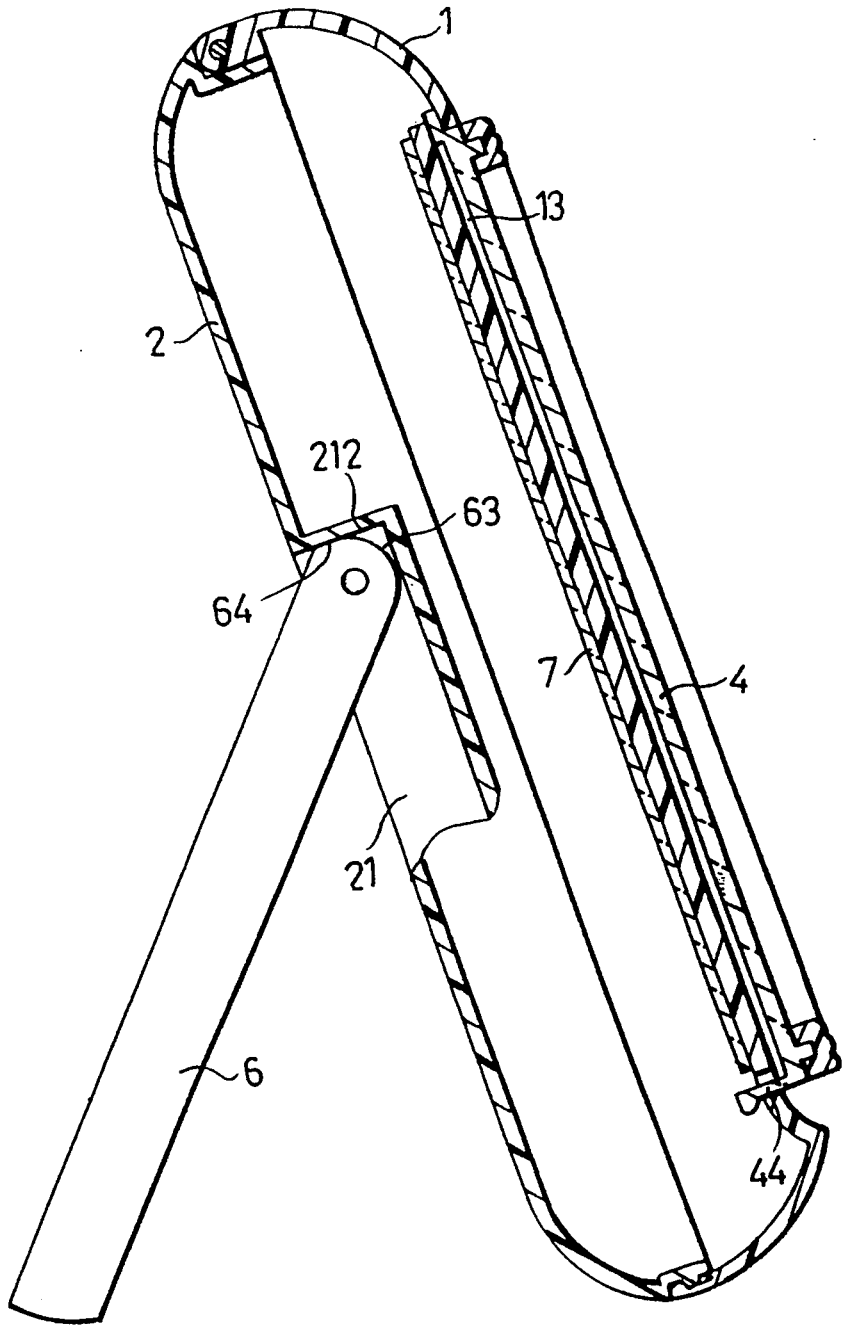
FIG. 3 illustrates the preferred embodiment when used as a picture stand.

Referring to FIG. 3, the pane member 4 should be removed before a picture can be placed in the central recess 13. To remove the pane member 4, a fingertip is extended into the notch 133 in order to push the fastening unit 44 away from the fastening groove 132. The pane member 4 is then lifted away from the first cosmetic casing half 1 in order to remove the insert projections 43 from the insert holes 131. The pane member 4 is replaced after the picture has been properly installed in the central recess 13.

The distal end of each of the upright arms 61 is formed with a curved edge portion 63 and a straight edge portion 64. The curved edge portion 63 permits pivoting movement of the stand member 6 away from the groove unit in the second cosmetic casing half 2. After the stand member 6 has been pivoted by a predetermined angle, the straight edge portion 64 abuts against a top wall 212 which confines the elongated groove 21 to arrest further pivoting movement of the stand member 6. This permits the combined cosmetic case and picture stand of the present invention to stand up properly on a table.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A combined cosmetic case and picture stand, comprising first and second cosmetic casing halves which are hinged to one another and which are provided with a catch means for retaining releasably said first and second cosmetic casing halves in a closed position, said first cosmetic casing half having an outer side which is formed with a central recess for receiving a picture therein, said outer side of said first cosmetic casing half having an inner periphery which confines said central recess and which is formed with a radial insert hole and a fastening groove, said second cosmetic casing half having an inner side which confines a space for receiving cosmetics therein and an outer side which is formed with a groove unit;

a transparent pane member having a shape which corresponds to that of said central recess, said pane member being received in said central recess and being formed with a peripheral frame unit that is mounted detachably to said outer side of said first cosmetic casing half, said frame unit of said pane member being provided with a radial insert projection that extends into said insert hole and a fastening unit that engages releasably said fastening groove; and a stand member mounted pivotally to said outer side of said second cosmetic casing half, said stand member being movable between a first position, wherein said stand member is received in said groove unit, and a second position, wherein said stand member forms an angle with said outer side of said second cosmetic casing half.

2. The combined cosmetic case and picture stand as claimed in claim 1, wherein said groove unit includes a pair of parallel elongated grooves, and said stand member is a generally U-shaped member with two upright arms that extend into said elongated grooves and that are connected pivotally to said second cosmetic casing half.

3. A combined cosmetic case and picture stand comprising:

first and second cosmetic casing halves which are hinged to one another and which are provided with a catch means for retaining releasably said first and second cosmetic casing halves in a closed position, said first cosmetic casing half having an outer side which is formed with a central recess for receiving a picture therein, said second cosmetic casing half having an inner side which confines a space for receiving cosmetics therein and an outer side which is formed with a groove unit;

a transparent pane member having a shape which corresponds to that of said central recess, said pane member being received in said central recess and being formed with a peripheral frame unit that is mounted detachably to said outer side of first cosmetic casing half;

a looped decorative frame mounted detachably on said frame unit of said pane member, said frame unit of said pane member having a frontwardly extending portion, and said decorative frame having a rear surface which is formed with a peripheral groove that receives said frontwardly extending portion therein; and a stand member mounted pivotally to said outer side of said second cosmetic casing half, said stand member being movable between a first position, wherein said stand member is received in said groove unit, and a second position, wherein said stand member forms an angle with said outer side of said second cosmetic casing half.

4. The combined cosmetic casing and picture stand as claimed in claim 3, wherein said groove unit includes a pair of parallel elongated grooves, and said stand member is a generally U-shaped member with two upright arms that extend into said elongated grooves and that are connected pivotally to said second cosmetic casing half.

* * * * *